United States Patent [19]

Frey

[11] Patent Number: 4,523,900

[45] Date of Patent: Jun. 18, 1985

[54] IMPELLER PUMP WITH SELF-PRIMING COLUMN ATTACHMENT

[75] Inventor: Max Frey, Portland, Oreg.

[73] Assignee: Roper Industries, Inc., Commerce, Ga.

[21] Appl. No.: 592,462

[22] Filed: Mar. 22, 1984

[51] Int. Cl.[3] ..... F04B 17/00

[52] U.S. Cl. ..... 417/365; 417/424; 415/143; 415/211

[58] Field of Search ..... 417/365, 424; 415/143, 415/199.6, 219 B, 100, 211

[56] References Cited

U.S. PATENT DOCUMENTS

| | | | |
|---|---|---|---|
| 2,865,296 | 12/1958 | Bungartz | 415/143 |
| 2,881,707 | 4/1959 | Thompson | 415/143 |
| 2,896,544 | 7/1959 | Ogles et al. | 415/143 |
| 3,723,019 | 3/1973 | Berman | 415/143 |
| 3,975,117 | 8/1976 | Carter | 415/143 |
| 4,335,886 | 6/1982 | Frey et al. | 277/25 |

FOREIGN PATENT DOCUMENTS

| | | | |
|---|---|---|---|
| 295850 | 4/1912 | Fed. Rep. of Germany | 415/211 |
| 1090519 | 10/1960 | Fed. Rep. of Germany | 415/211 |
| 512311 | 6/1976 | U.S.S.R. | 415/143 |

OTHER PUBLICATIONS

Fiese and Firstenberger Mfg., Inc. product brochure.

*Primary Examiner*—Carlton R. Croyle
*Assistant Examiner*—Donald E. Stout
*Attorney, Agent, or Firm*—Kolisch, Hartwell & Dickinson

[57] ABSTRACT

The combination of a motor-driven impeller pump assembly and a self-priming column attachment. The column attachment is detachably secured to the pump assembly and includes an elongate shaft exterior which is attached to an impeller in the pump assembly with a detachable connection. An axial flow inducer is located at the bottom end of the column attachment and serves to lift a fluid in the column towards the impeller. A balance line conduit extends from a balance chamber located behind the impeller downwards on the extension of the column to the level of the axial flow inducer, thereby serving to lessen axially imbalanced forces acting on the impeller pump assembly. The column also includes a set of straightener vanes to reduce rotational flow through the length of the column. A double-volute chamber surrounding the impeller serves to radially balance forces acting on the impeller, the motor and their associated bearings.

6 Claims, 4 Drawing Figures

IMPELLER PUMP WITH SELF-PRIMING COLUMN ATTACHMENT

BACKGROUND AND SUMMARY OF THE INVENTION

This invention relates to a centrifugal pump and self-priming column attachment.

Centrifugal pumps have found extensive use in applications where it is desired to provide a high volume flow of fluid in an economical and reliable manner. Centrifugal pumps are not self-priming, which has limited their use in applications where the source of fluid to be pumped is located well below the level of the pump. Thus, in so-called deep well applications, as exemplified, for instance, in irrigation systems where the water supply is found in a deep well, it has been common to employ a special type of pump where the impeller, in effect, is carried adjacent the bottom end of an elongate motor-driven shaft extending downwardly from the motor that drives it into the level of the fluid pumped. There are certain inefficiencies in such a system, with the impeller being required to produce an axial flow of pressurized liquid rather than the radial type discharge which a centrifugal pump most efficiently produces. Furthermore, a pump of this description tends to be a special type of manufactured product, which reflects in a higher cost for the equipment. Centrifugal pumps with axial flow attachments to produce feed of liquid to the eye of the impeller in the pump have been proposed, but have been subject to disadvantages in not adequately taking care of radial and axial loading of the impeller shaft and noise and vibration which occurs as the result of water turbulence and other factors during pump operation.

A general object of this invention is to provide a novel combination of centrifugal pump and self-priming column attachment which obviates many of the problems normally associated with centrifugal pumps when utilized in deep well or similar applications.

More specifically, an object of the invention is to provide such a combination where provision is made for minimizing radial and axial loading of the shaft driving the impeller, with the result that bearing structure associated with a conventional centrifugal pump may be utilized in the combination with entirely satisfactory loading obtainable, and with the further result that stress failure in the region where the attachment is made is effectively minimized.

A still further object of the invention is to provide such a centrifugal pump and self-priming attachment combination constructed in such a manner that water turbulence and resulting noise and vibration occurring during pump operation is maintained at a minimum.

In light of the above stated objects, the instant invention includes a self-priming column attachment which is detachably secured to a motor-driven centrifugal pump assembly. The pump assembly includes a motor with an output shaft, an impeller housing which has an inlet in its base and contains an impeller which is mounted on one end of the motor output shaft, facing the inlet. The impeller housing defines a balance chamber above the impeller. The column attachment includes an elongate, tubular column which has an upper extent conforming to the interior diameter of the inlet, and a bottom, bowl-shaped portion which is intended to remain submerged. An elongate shaft extension is rotatably mounted within and extends axially in the column, and is detachably connected at its upper end to the output shaft adjacent the impeller. An axial flow inducer is mounted at the bottom end of the shaft extension. The axial flow inducer includes a hub assembly and a set of propeller blades which will induce upward movement of fluid within the column when the pump motor is turned on, thereby providing fluid flow to the impeller and priming the centrifugal pump assembly.

Additionally, a balance line conduit connects at its upper end with the balance chamber, and its lower end is located in the general area of the axial flow inducer, thereby reducing axial loading on the output shaft and associated bearings within the motor and the column attachment. Equally circumferentially spaced straightener vanes located within the bowl and the use of a double-volute impeller chamber substantially reduce radial loading on the pump motor and associated shafts and bearings.

These and other objects and advantages of the instant invention will become more fully apparent as the description which follows is read in conjunction with the drawings.

DETAILED DESCRIPTION OF THE DRAWINGS

Figure 1:
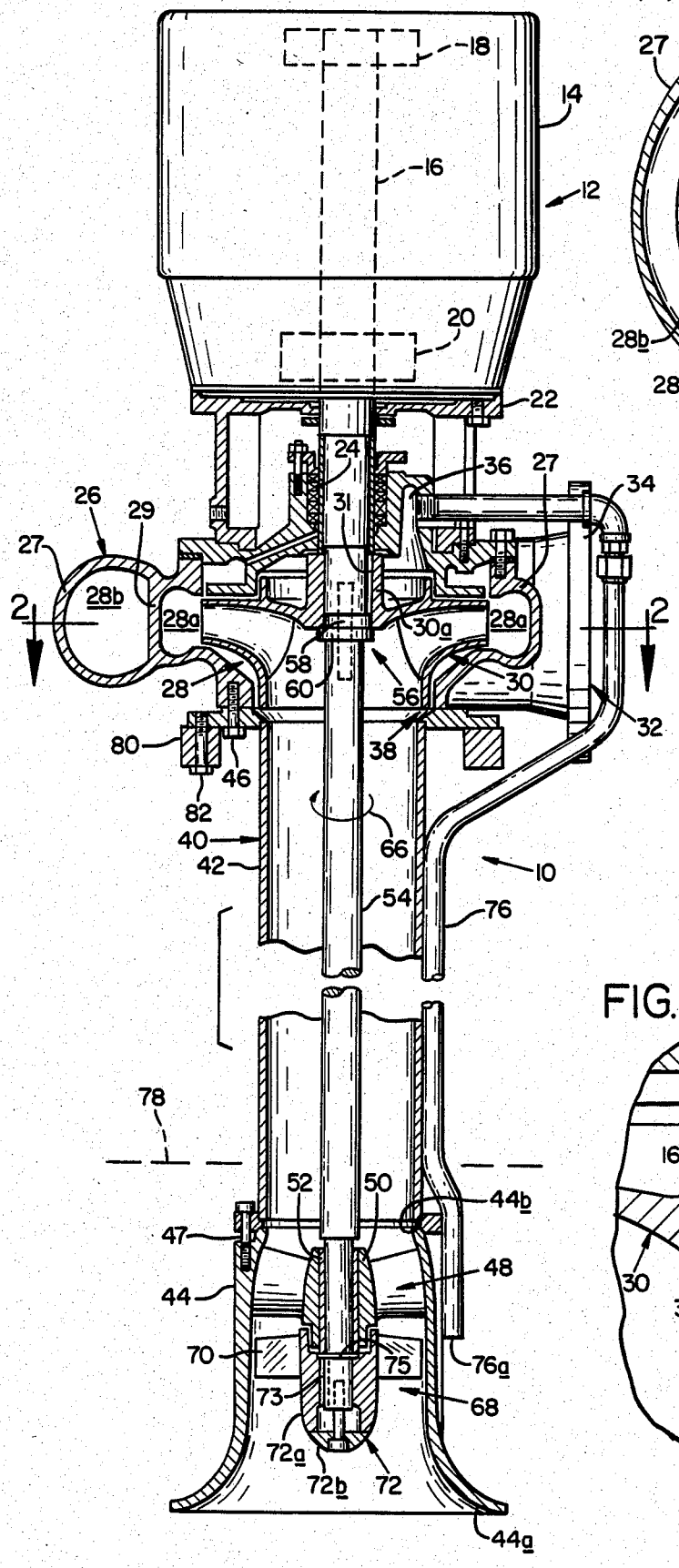
FIG. 1 illustrates a combination of a motor-driven centrifugal pump assembly and a self-priming column attachment constructed according to the instant invention with portions cut away to reveal interior detail.

Turning now to the drawings, and initially to FIG. 1, a self-priming column attachment is shown generally at 10. The attachment is detachably secured to a motor-driven centrifugal pump assembly 12.

Describing initially the pump assembly, the pump assembly includes a motor 14, which is typically of the three-phase type. Motor 14 includes an output shaft 16, which is mounted by bearings 18, 20 within the motor.

Motor 14 is mounted atop a frame 22. Shaft 16 extends from motor 14 through a packing arrangement 24. The shaft then extends into an impeller housing, shown generally at 26.

Indicated at 30 is an impeller of conventional construction. The impeller includes a hub **30*a* which surrounds a lower, reduced-diameter end portion of output shaft 16. The upper end of hub 30*a* seats against a shoulder formed where the reduced-diameter end portion of the shaft meets with the remainder of the shaft. Keying the shaft and the hub together for simultaneous rotation is key 31**.

Figure 2:
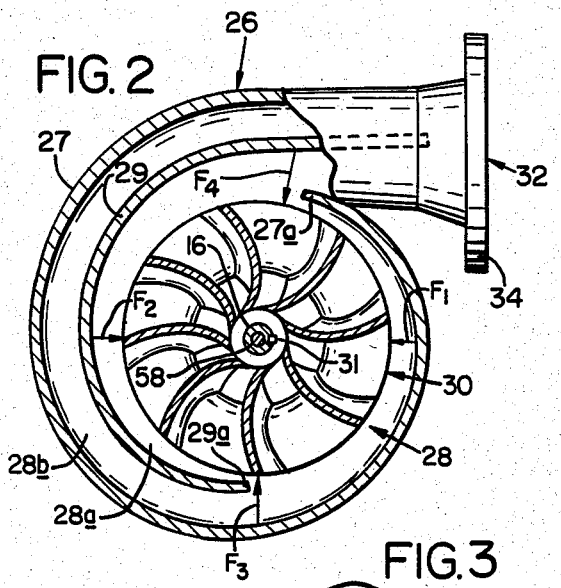
FIG. 2 is a reduced scale cross-sectional view through a double-volute impeller chamber in the assembly, taken generally along the line 2—2 in FIG. 1.

Impeller housing 26 includes wall structure which defines a so-called double-volute chamber 28. More specifically, and with reference now to FIGS. 1 and 2, the impeller housing has a radially outer wall 27 which extends generally in a spiral configuration looking downwardly on the impeller housing. This wall is shown in FIG. 2 as starting at the region indicated at 27*a*. The chamber housing the impeller gradually enlarges progressing in a clockwise direction in FIG. 2 from region 27*a*. Approximately diametrically across from region 27*a* is the starting region 29*a* of an internal wall 29 also extending in a substantially enlarging spiral. With this wall structure, the double-volute chamber is defined which includes, progressing in a clockwise direction from region 29*a*, an outer chamber 28*b* of substantially uniform size and an inner chamber 28*a* of progressively increasing size, wherein the impeller resides.

The result of the construction described is that radial forces acting upon the impeller tend to be equalized in regions extending about the axis of the impeller. Thus, and referring to FIG. 2, the arrow $F_1$ is indicative of the extent of the radial force acting upon the impeller from the right side of the housing and is substantially equal in length to the arrow $F_2$ indicative of the radial force acting upon the impeller on the left side of the housing. Similarly, arrow $F_3$ is indicative of a radial force of substantially the same magnitude as arrow $F_4$, in a diametrically opposite location.

The impeller housing 26 just described further includes an outlet 32 surrounded by flange 34 disposed radially outwardly of where the impeller is located. At the base of the housing is an inlet 38 to the impeller housing of substantially circular outline which faces downwardly. During operation of the pump, fluid being pumped enters the inlet and is forced, at higher pressure, outwardly through the double-volute chamber described to be exhausted through the outlet 32.

With operation of the pump, the pressure of fluid being pumped adjacent the inlet is substantially less than the pressure of fluid being expelled by the impeller and moved toward the outlet of the pump. In the usual pump, and referring to FIG. 1, minor amounts of the fluid being pumped tend to travel over the backside of the impeller (the upper side down in FIG. 1) to collect within a chamber shown at 36 referred to herein as a balance chamber. Without proper provision made for pressure adjustment, the pressure of fluid collecting within this chamber produces an axial loading of the motor output shaft tending to force such downwardly in FIG. 1.

Self-priming column attachment 10 includes an elongate hollow column 40 which includes a tubular upper extent 42 and a bottom extent in the form of a bowl 44. Upper extent 42 is detachably secured to the base of impeller housing 26 by means of fasteners, such as bolt 46. The interior of column 40 connects with inlet 38 and makes a smooth transition therewith.

Bowl 44 forms the bottom of column 40. It is suitably attached to column 40. This may be by fasteners, such as bolt 47, or alternately, the bowl may be threaded onto the lower end of column 40. Bowl 44 has converging sides of initially greater diameter than column 40, indicated at 44*a*. These sides converge to a section of smaller diameter 44*b* which has the same diameter as the diameter of the tubular upper extent. Thus, a smooth transition is made between bowl 44 and extent 42.

Figure 3:
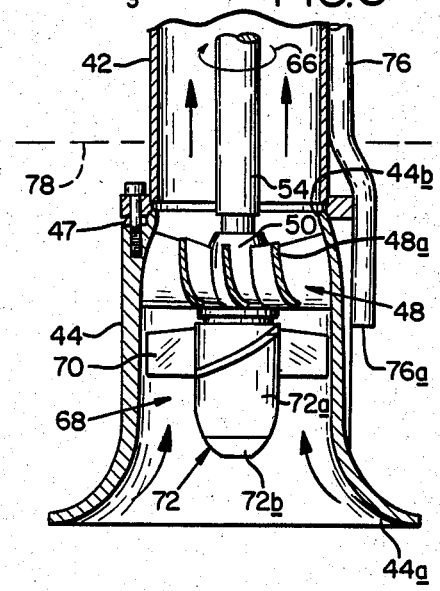
FIG. 3 shows the bottom of the self-priming column attachment, without breaking away of internal structures as in FIG. 1.

A set of equally circumferentially spaced straightener vanes 48 is integrally formed with bowl 44. In the embodiment illustrated there are nine such vanes provided. Ordinarily, the bowl is formed as a casting, and these vanes are cast together with the bowl to be integrally formed therewith. Each vane curves, as shown in connection with vane 48*a* shown in FIG. 3 from a bottom extent that extends at an angle with respect to the axis of the column to a substantially lineal at the upper part of the vane which extends substantially axially in the column.

The vanes meet at a bearing mount 50, which supports a shaft extension bearing 52.

An elongate shaft extension 54 is axially mounted within the column. Shaft 54 extends into the impeller housing at its upper end and its lower end extends through shaft extension bearing 52.

Figure 4:
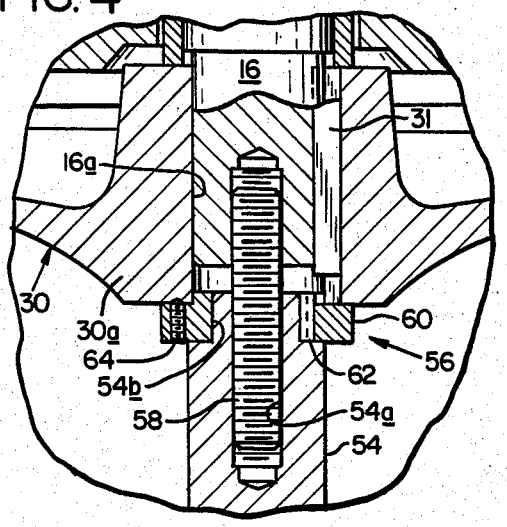
FIG. 4 is an enlarged view of a detachable connection between a motor output shaft and a shaft extension employed in the construction.

Shaft extension 54 (and reference is now made to FIGS. 1 and 4) is detachably connected to output shaft 16 by means of a detachable connection, shown generally at 56. Connection 56 includes an axial extending threaded fastener 58 which is received in complementary threaded bores 16*a* and 54*a* in the output shaft and shaft extension, respectively. A collar 60 surrounds threaded fastener 58 and abuts the end of hub 30*a*. Collar 60 also extends over a stepped portion 54*b* of shaft extension 54. Collar 60 is keyed to shaft 54 by means of key 62. Set screws, such as that shown at 64, are circumferentially distributed about collar 60 and abut the end of hub 30*a* thereby preventing rotation of hub 30*a* relative collar 60. There may be 3 or 4 set screws. The threads on threaded fastener 58 and in complementary bores 16*a* and 54*a* are arranged such that they resist rotational loading in one direction of rotation of the output shaft, as shown by arrow 66 (see FIG. 1). Key 62 and set screws 64 resist rotational loading when the output shaft is rotated in a direction opposite arrow 66, which might occur should motor 14 be connected to an electrical supply improperly. The connection between centrifugal impeller 30 and shaft extension 54 is thereby provided with fail-safe means to prevent disengagement of the shaft from the impeller.

An axial flow inducer, shown generally at 68 is connected to the bottom end of shaft extension 54. The inducer is located below the level of the straightening vanes within bowl 44. In the preferred embodiment, the axial flow inducer is a set of four propeller blades 70, which is mounted on a streamlined hub assembly 72. Hub assembly 72 includes an upper portion 72*a* on which the propeller blades are mounted, and a lower, separable portion 72*b*. Upper portion 72*a* is keyed to the shaft extension by a key 73. A fastener, such as bolt 74, passes through portion 72*b* and into the bottom end of shaft extension 54, thereby securing the parts together. A retaining ring 75 prevents dislocation of hub assembly 72 upwards on shaft 54.

A balance line conduit 76 is connected at its upper end with balance chamber 36. The line extends along the outside of the column 40 to approximately the level of axial flow inducer 68, where it terminates in an open end 76*a*.

In operation, the combined centrifugal pump assembly and self-priming column attachment are joined, and positioned with the bottom of the column attachment submerged in the fluid being pumped. The level of the fluid may be as shown generally by the dashed line 78. The impeller housing is detachably secured to a pump support 80, by means of fasteners, such as bolt 82.

Explaining now the operation of the centrifugal pump and self-priming attachment combination described, with energizing of motor 14, its output shaft and the shaft extension are caused to rotate. This produces rotation of the axial flow inducer at the base of the shaft extension which inducer is submerged in the fluid being pumped. For purposes of this explanation, it will be assumed that rotation of the output shaft and shaft extension is as shown by the arrow 66.

The propeller-type axial flow inducer shown and described produces essentially axial flow of liquid moved although there is some centrifugal flow of movement produced in the liquid. The straightener vanes described serve to remove such centrifugal movement and convert such to axial flow on such fluid moving over the curved surfaces of the vanes.

The liquid moved upwardly in the column by the axial flow inducer passes through the inlet of the impeller housing to be engaged by the rotating impeller. At such time priming of the centrifugal pump assembly results.

As earlier described, a minor portion of the fluid being pumped collects in chamber 36 above the impeller. Without the balance line described, the pressure of this fluid substantially exceeds the pressure of fluid entering the inlet to the impeller housing and exceeds to an even greater extent the pressure of fluid adjacent the base of the shaft extension being urged upwardly by the axial flow inducer. By the provision of balance line 76, the pressure of fluid within chamber 36 is maintained at a substantially lower level approximately equaling the pressure of fluid entering the axial flow inducer, plus a slight pressure effect produced by the fluid column contained in the balance line. As a result, axial loading of the motor output shaft and the shaft extension, is substantially reduced. In the combination, no special axial thrust bearings need be provided supplementing or replacing the bearing 20 normally associated with the motor output shaft 16.

In the combination described, a connection is established between the lower end of the motor output shaft and the upper end of the shaft extension. The region of this connection is subject to stress failure in the construction where proper provision is not made for minimizing unequal radial loading of the motor output shaft. The double-volute chamber of the impeller housing earlier described tends to produce an equal distribution of radial loads in this region thus to inhibit stress failures at this region of the connection.

Further contributing to the stability of operation of the organization is the provision of the straightener vanes tending to produce a substantially purely axial flow of fluid into the inlet of the pump.

When installing the combination described in a given installation, the direction that the motor rotates is depended on how the motor leads are connected to the three phase power supply. Frequently an installer is not aware of the direction of motor rotation until after an electrical connection has been established. With an improper connection of the electrical leads, rotation of the output shaft and the shaft extension could be in a direction opposite to the direction of arrow 66 illustrated in FIG. 1. The fastener and collar assembly utilized in coupling the shaft extension to the motor output shaft serve as a fail-safe device to prevent, in the case of such an improper electrical connection, separation of extension from the output shaft and resultant damage.

Fluid flow into and through the column extension into the interior of the impeller housing is essentially devoid of turbulence by reason of the presence of the bowl described and the smooth transition between the interior of the column with the eye of the impeller housing (and the presence of the straightener vanes). As a result, vibration and noise during operation of the combination is maintained at a minimum level.

While an embodiment of the invention has been described, obviously modifications and variations are possible without departing from the invention.

It is claimed and desired to secure as Letters Patent:

1. The combination of a motor-driven centrifugal pump assembly including an impeller housing with an inlet as the base thereof, an impeller within said housing facing said inlet, and a motor including an output shaft disposed above the impeller housing, said output shaft extending into and being drivingly connected to said impeller, a self-priming column attachment detachably secured to the pump assembly including an elongate hollow column having its upper end secured to the impeller housing with the interior of the column connecting with said inlet, an elongate shaft extension extending axially within said column with a detachable connection between the upper end of said shaft extension and said output shaft, bearing means rotatably supporting said shaft extension within said column adjacent the bottom end of the column, and an axial flow inducer within said column connected to said shaft extension, said impeller housing having walls defining a double-volute impeller chamber enclosing the impeller within the housing, and a balance chamber disposed upwardly of and behind the impeller receiving fluid under pressure from the impeller, and a balance line conduit connected at its upper end with said balance chamber and extending to an open, lower end disposed at substantially the level of said axial flow inducer, said double-volute chamber serving to radially balance said output shaft in the region of said connection between said shaft extension and said output shaft and said balance line conduit serving to axially balance said shaft extension which extends from said connection.

2. The combination of claim 1, wherein said detachable connection between said shaft extension and said output shaft comprises an axially extending threaded fastener and complementing threaded bores in said output shaft and said shaft extension which face each other, said fastener being received within said bores and producing a fast connection resisting rotational loading in one direction of rotation for said output shaft, a collar surrounding said fastener, and means locking said collar to said output shaft and shaft extension, respectively, resisting rotational loading in an opposite direction of rotation.

3. The combination of claim 2, wherein said column includes a tubular upper extent and a bowl forming the bottom end of the column, said bowl having an open bottom and sides that converge progressing upwardly from said open bottom to form a section of smaller diameter making a smooth transition with said tubular extent, said tubular extent having an upper end with a diameter making a smooth transition with said inlet.

4. The combination of claim 3, which further comprises straightener vanes disposed above said axial flow inducer and formed as an integral part of said bowl, said bearing means being mounted on said vanes, said shaft extension having a bottom end disposed below said vanes, a streamlined hub assembly detachably secured to said extension shaft bottom end facing downwards in said bowl, said axial flow inducer comprising propeller blades extending radially outwards of and joined to said hub assembly.

5. The combination of claim 1, wherein said column includes a tubular upper extent and a bowl forming the bottom end of the column, said bowl having an open bottom and sides that coverage progressing upwardly from said open bottom to form a section of smaller diameter making a smooth transition with said tubular extent, said tubular extent having an upper end with a diameter making a smooth transition with said inlet.

6. The combination of claim 1, which further comprises straightener vanes disposed above said axial flow inducer and formed as an integral part of said bowl, said bearing means being mounted on said vanes, said shaft extension having a bottom end disposed below said vanes, a streamlined hub assembly detachably secured to said extension shaft bottom end facing downward in said bowl, said axial flow inducer comprising propeller blades extending radially outwards of and joined to said hub assembly.

* * * * *